US009603467B2

(12) United States Patent
Lockwood

(10) Patent No.: US 9,603,467 B2
(45) **Date of Patent: *Mar. 28, 2017**

(54) SECURE MERCHANDISING DISPLAY WITH TUNNEL FEATURE

(71) Applicant: WestRock Shared Services, LLC, Norcross, GA (US)

(72) Inventor: Thomas A. Lockwood, Clemmons, NC (US)

(73) Assignee: WestRock Shared Services, LLC, Norcross, GA (US)

( * ) Notice: Subject to any disclaimer, the term of this patent is extended or adjusted under 35 U.S.C. 154(b) by 63 days.

This patent is subject to a terminal disclaimer.

(21) Appl. No.: 14/538,237

(22) Filed: Nov. 11, 2014

(65) Prior Publication Data

US 2015/0060480 A1 Mar. 5, 2015

Related U.S. Application Data

(63) Continuation of application No. 13/466,580, filed on May 8, 2012, now Pat. No. 8,910,827.

(60) Provisional application No. 61/484,246, filed on May 10, 2011.

(51) Int. Cl.
*A47F 1/12* (2006.01)

(52) U.S. Cl.
CPC ..... *A47F 1/126* (2013.01)

(58) Field of Classification Search
CPC .... A47F 1/12; A47F 1/04; A47F 1/125; A47F 7/28; G07F 11/38
USPC ..... 221/8, 14, 260, 280; 700/236
See application file for complete search history.

(56) References Cited

U.S. PATENT DOCUMENTS

| | | | |
|---|---|---|---|
| 691,990 | A | 1/1902 | Warren |
| 1,034,318 | A | 7/1912 | Sobretto et al. |
| 1,123,071 | A | 12/1914 | Bell |
| 1,319,084 | A | 10/1919 | Hume |
| 1,533,147 | A | 4/1925 | Svendsgaard |
| 1,592,720 | A | 7/1926 | Butler |

(Continued)

FOREIGN PATENT DOCUMENTS

| | | |
|---|---|---|
| DE | 202005010088 | 9/2005 |
| DE | 202005019621 | 2/2006 |

(Continued)

OTHER PUBLICATIONS

U.S. Appl. No. 13/466,580, Non-Final Office Action mailed May 5, 2014, 8 pages.

(Continued)

*Primary Examiner* — Timothy Waggoner
(74) *Attorney, Agent, or Firm* — WestRock IP Legal

(57) ABSTRACT

Disclosed is a dispenser for controlling access to product, such as but not limited to bottles, housed within the dispenser. In some embodiments, the dispenser includes an opening having a contour that generally mirrors the shape and/or dimensions of the product stored within the dispenser plus a relatively small amount of clearance and also includes a tunnel within the interior of the device. The configuration of the opening and/or the tunnel feature prevents a user from accessing product stored behind the opening within the dispenser. In some embodiments, the dispenser includes a pusher system that provides a time delay between the dispensing of products into a receiving area.

20 Claims, 9 Drawing Sheets

(56) References Cited

U.S. PATENT DOCUMENTS 1,614,363 A 1/1927 Hicks
1,680,275 A 8/1928 Albaugh
1,755,655 A 4/1930 Langenfeld
1,813,935 A 7/1931 Knee
1,841,926 A 1/1932 Wray
1,913,843 A 6/1933 Marcuse
2,142,053 A 12/1938 Hoban
2,163,280 A 6/1939 Hibshman
2,215,024 A 9/1940 Tuyl
2,304,533 A 12/1942 Bright
2,412,368 A 2/1945 Tascher
2,586,241 A 2/1952 Manley
2,824,666 A 2/1958 Hausladen
2,977,023 A 3/1961 Meyer
2,990,228 A 6/1961 Celler
3,161,295 A 12/1964 Chesley
3,199,724 A 8/1965 Domenico et al.
3,313,448 A 4/1967 Suttle et al.
3,351,233 A 11/1967 Chanoch et al.
3,452,899 A 7/1969 Libberton
3,578,207 A 5/1971 Danow
3,583,568 A 6/1971 Crossien
3,591,048 A 7/1971 Myers et al.
3,743,137 A 7/1973 Bennett
3,749,279 A 7/1973 Ungerman
3,752,357 A 8/1973 Harris
3,776,418 A 12/1973 Bookout
3,777,931 A 12/1973 Fleming
3,796,345 A 3/1974 Fessler
3,805,962 A 4/1974 Bendiksen
3,885,706 A 5/1975 Lodge
3,923,159 A 12/1975 Taylor et al.
3,957,173 A 5/1976 Roudebush
3,968,900 A 7/1976 Stambuk
3,999,662 A 12/1976 Barnhardt
4,007,853 A 2/1977 Bahneman
4,010,869 A 3/1977 Adamo
4,018,100 A 4/1977 Moe
4,036,400 A 7/1977 Oden
4,190,179 A 2/1980 Moss et al.
4,228,903 A 10/1980 Eckert
4,275,819 A 6/1981 Perez
4,308,974 A 1/1982 Jones
4,336,892 A 6/1982 Cox et al.
4,369,887 A 1/1983 Emery
4,371,093 A 2/1983 Berger
4,412,607 A 11/1983 Collins et al.
4,474,300 A 10/1984 Entis
4,506,607 A 3/1985 Jacoby
4,576,272 A 3/1986 Morgan et al.
4,679,684 A 7/1987 Glaser
4,682,826 A 7/1987 Mestdagh
4,742,936 A 5/1988 Rein
4,779,760 A 10/1988 Wittern et al.
4,852,767 A 8/1989 Humphrey
4,887,737 A 12/1989 Adenau
4,954,760 A 9/1990 Futch et al.
4,962,867 A 10/1990 Ficken et al.
4,965,551 A 10/1990 Box
5,012,936 A 5/1991 Crum
5,046,641 A 9/1991 Gray
5,067,634 A 11/1991 Vidondo
5,096,367 A 3/1992 Winski
5,097,611 A 3/1992 Smollar et al.
5,111,942 A 5/1992 Bernardin
5,121,854 A 6/1992 Trouteaud et al.
5,150,101 A 9/1992 Goris et al.
5,150,817 A 9/1992 Livingston
5,169,027 A 12/1992 Falk et al.
5,199,598 A 4/1993 Sampson
5,229,749 A 7/1993 Yenglin
5,232,102 A 8/1993 Ozawa
5,240,126 A 8/1993 Foster et al.
5,248,060 A 9/1993 Friedman et al.
5,249,705 A 10/1993 Gates
5,252,948 A 10/1993 Goris et al.
5,253,782 A 10/1993 Gates et al.
5,261,208 A 11/1993 Lockhart
5,263,596 A 11/1993 Williams
5,269,597 A 12/1993 Yenglin et al.
5,285,926 A 2/1994 Falk et al.
5,335,816 A 8/1994 Kaufman et al.
5,335,818 A 8/1994 Maldanis
5,360,134 A 11/1994 Falk
5,375,735 A 12/1994 Huvey et al.
5,375,737 A 12/1994 Ficken
5,385,266 A 1/1995 Pate
5,390,821 A 2/1995 Markel
5,397,025 A 3/1995 Lee
5,400,919 A 3/1995 Gomm et al.
5,439,136 A 8/1995 Chatani et al.
5,450,969 A 9/1995 Johnson et al.
5,460,294 A 10/1995 Williams
5,462,198 A 10/1995 Schwimmer
5,542,552 A 8/1996 Yablans et al.
5,586,665 A 12/1996 Brousseau
5,632,408 A 5/1997 Mitchell
5,665,304 A 9/1997 Heinen et al.
5,709,315 A 1/1998 Kahler et al.
5,716,114 A 2/1998 Holmes et al.
5,790,409 A 8/1998 Fedor et al.
5,813,568 A 9/1998 Lowing
5,829,630 A 11/1998 Fernald
5,855,281 A 1/1999 Rabas
5,881,910 A 3/1999 Rein
5,909,932 A 6/1999 Shih
5,927,540 A 7/1999 Godlewski
5,960,984 A 10/1999 Weston
5,960,988 A 10/1999 Freixas
6,084,511 A 7/2000 Kil
6,112,938 A 9/2000 Apps
6,131,748 A 10/2000 Kawasaki et al.
6,176,558 B1 1/2001 Hlade et al.
6,189,727 B1 2/2001 Shoenfeld
6,196,416 B1 3/2001 Seagle
6,199,720 B1 3/2001 Rudick et al.
6,206,237 B1 3/2001 Dillon et al.
6,230,932 B1 5/2001 Lowing et al.
6,241,121 B1 6/2001 Yasaka
6,263,259 B1 7/2001 Bartur
6,301,501 B1 10/2001 Cronin et al.
6,318,591 B1 11/2001 Martin
6,325,242 B1 12/2001 Izawa et al.
6,454,107 B1 9/2002 Belanger et al.
6,464,089 B1 10/2002 Rankin
6,474,478 B1 11/2002 Huchner et al.
6,478,187 B2 11/2002 Simson et al.
6,520,604 B1 2/2003 Yasaka et al.
6,581,798 B2 6/2003 Liff et al.
6,601,416 B1 8/2003 Sanders
6,604,652 B1 8/2003 Trautwein
6,622,979 B2 9/2003 Valiulis
6,659,291 B2 12/2003 Huchner et al.
6,684,126 B2 1/2004 Omura et al.
6,688,491 B2 2/2004 Bliek et al.
6,691,891 B2 2/2004 Maldonado
6,694,221 B2 2/2004 Chavez et al.
6,735,473 B2 5/2004 Kolder et al.
D491,403 S 6/2004 Gervasi
6,758,370 B2 7/2004 Cooke et al.
6,776,304 B2 8/2004 Liff et al.
6,786,341 B2 9/2004 Stinnett et al.
6,814,254 B2 11/2004 Liff et al.
6,814,255 B2 11/2004 Liff et al.
6,857,539 B2 2/2005 Parra
6,892,898 B1 5/2005 Boone et al.
6,957,555 B1 10/2005 Nagel et al.
7,007,810 B2 3/2006 Huehner et al.
7,017,778 B2 3/2006 Halbherr
7,024,894 B2 4/2006 Salonen
7,032,776 B2 4/2006 Hieb
D521,363 S 5/2006 Copen et al.
7,052,097 B2 5/2006 Meek, Jr. et al.
7,086,541 B2 8/2006 Robertson

(56) References Cited

U.S. PATENT DOCUMENTS

| | | | | |
|---|---|---|---|---|
| 7,128,221 | B2 | 10/2006 | Metcalf | |
| 7,128,239 | B2 | 10/2006 | Skavnak | |
| 7,149,600 | B2 | 12/2006 | Rippolone | |
| 7,150,365 | B2 | 12/2006 | Hardy et al. | |
| 7,151,982 | B2 | 12/2006 | Liff et al. | |
| 7,178,678 | B2 | 2/2007 | Mansfield et al. | |
| 7,197,902 | B1 | 4/2007 | Barkdoll | |
| 7,207,447 | B2 | 4/2007 | Medcalf et al. | |
| 7,213,722 | B2 | 5/2007 | Nagelski et al. | |
| 7,246,711 | B1 | 7/2007 | Metcalf | |
| 7,249,761 | B2 | 7/2007 | Graef et al. | |
| 7,264,138 | B2 | 9/2007 | Collins et al. | |
| 7,269,983 | B1 | 9/2007 | Mchatet | |
| 7,293,672 | B2 | 11/2007 | Mori | |
| 7,299,934 | B2 | 11/2007 | Hardy et al. | |
| 7,303,095 | B2 | 12/2007 | Nagelski | |
| 7,347,335 | B2 | 3/2008 | Rankin, VI et al. | |
| 7,348,884 | B2 | 3/2008 | Higham | |
| 7,389,886 | B2 | 6/2008 | Hardy et al. | |
| 7,451,881 | B2 | 11/2008 | Hardy et al. | |
| 7,458,473 | B1 | 12/2008 | Mason | |
| 7,469,791 | B2 | 12/2008 | Phoy | |
| 7,497,341 | B2 | 3/2009 | Hardy et al. | |
| 7,533,784 | B2 | 5/2009 | Vlastakis et al. | |
| 7,564,351 | B2 | 7/2009 | Nagelski et al. | |
| 7,621,409 | B2 | 11/2009 | Hardy et al. | |
| 7,641,072 | B1 | 1/2010 | Vlastakis et al. | |
| 7,661,545 | B2 | 2/2010 | Hardy et al. | |
| 7,669,722 | B2 | 3/2010 | Hardy et al. | |
| 7,675,421 | B2 | 3/2010 | Higham | |
| 7,768,399 | B2 | 8/2010 | Hachmann et al. | |
| 7,823,734 | B2 | 11/2010 | Hardy | |
| 7,828,158 | B2 | 11/2010 | Colelli et al. | |
| 8,013,740 | B2 | 9/2011 | Irmscher et al. | |
| 8,038,016 | B2 | 10/2011 | Yuyama et al. | |
| 8,047,385 | B2 * | 11/2011 | Hardy | A47F 1/12 211/59.3 |
| 8,056,734 | B2 | 11/2011 | Menz et al. | |
| 8,056,740 | B2 | 11/2011 | Weshler et al. | |
| 8,090,473 | B2 | 1/2012 | Higham | |
| 8,146,753 | B2 | 4/2012 | Yuyama | |
| 8,190,289 | B2 | 5/2012 | Lockwood et al. | |
| 8,215,520 | B2 | 7/2012 | Miller et al. | |
| 8,910,827 | B2 * | 12/2014 | Lockwood | 221/14 |
| 2003/0029816 | A1 | 2/2003 | Huchner et al. | |
| 2003/0121929 | A1 | 7/2003 | Liff et al. | |
| 2003/0178435 | A1 | 9/2003 | Yamaguchi | |
| 2003/0189058 | A1 | 10/2003 | Liff et al. | |
| 2004/0026344 | A1 | 2/2004 | Sedon et al. | |
| 2004/0059464 | A1 | 3/2004 | Veenstra et al. | |
| 2004/0060944 | A1 | 4/2004 | Gervasi | |
| 2004/0084386 | A1 | 5/2004 | Huchner et al. | |
| 2004/0104239 | A1 | 6/2004 | Black et al. | |
| 2004/0149768 | A1 | 8/2004 | Scoville et al. | |
| 2004/0238557 | A1 | 12/2004 | Chirnomas | |
| 2005/0029205 | A1 | 2/2005 | Mansfield et al. | |
| 2005/0029283 | A1 | 2/2005 | Pedigo | |
| 2005/0065645 | A1 | 3/2005 | Liff et al. | |
| 2005/0161413 | A1 | 7/2005 | Close | |
| 2005/0167377 | A1 | 8/2005 | Robertson | |
| 2005/0189369 | A1 | 9/2005 | Vlastakis | |
| 2005/0189370 | A1 | 9/2005 | Carter et al. | |
| 2005/0199644 | A1 | 9/2005 | Pensenti Barili et al. | |
| 2005/0205596 | A1 | 9/2005 | Kelly | |
| 2005/0252925 | A1 | 11/2005 | Kelly | |
| 2006/0138915 | A1 | 6/2006 | Goldberg | |
| 2006/0157431 | A1 | 7/2006 | Nagelski et al. | |
| 2006/0163272 | A1 | 7/2006 | Gamble | |
| 2006/0219730 | A1 | 10/2006 | Handfield et al. | |
| 2006/0237381 | A1 | 10/2006 | Lockwood et al. | |
| 2006/0266762 | A1 | 11/2006 | Andrews et al. | |
| 2006/0293784 | A1 | 12/2006 | Braunstein | |
| 2007/0029340 | A1 | 2/2007 | Nagelski et al. | |
| 2007/0078561 | A1 | 4/2007 | Sansone | |
| 2007/0080175 | A1 | 4/2007 | Peterson | |
| 2007/0119796 | A1 | 5/2007 | Barkdoll | |
| 2007/0199863 | A1 | 8/2007 | Knoettgen-Nap | |
| 2007/0221679 | A1 | 9/2007 | Chandler et al. | |
| 2007/0251900 | A1 | 11/2007 | Hardy | |
| 2007/0273513 | A1 | 11/2007 | White | |
| 2007/0278164 | A1 | 12/2007 | Lang et al. | |
| 2007/0283615 | A1 | 12/2007 | Vlastakis | |
| 2008/0092394 | A1 | 4/2008 | Freitag et al. | |
| 2008/0142538 | A1 | 6/2008 | Miller | |
| 2008/0246375 | A1 | 10/2008 | Berg | |
| 2008/0283477 | A1 | 11/2008 | Wamsley et al. | |
| 2009/0084745 | A1 | 4/2009 | Goehring | |
| 2009/0166304 | A1 | 7/2009 | Hardy et al. | |
| 2009/0184069 | A1 | 7/2009 | Hardy | |
| 2009/0184129 | A1 | 7/2009 | Vlastakis et al. | |
| 2009/0184130 | A1 | 7/2009 | Miller et al. | |
| 2009/0242582 | A1 | 10/2009 | Vlastakis et al. | |
| 2009/0321373 | A1 | 12/2009 | Hardy | |
| 2010/0017025 | A1 | 1/2010 | Lockwood | |
| 2010/0079240 | A1 | 4/2010 | Higham | |
| 2010/0147783 | A1 | 6/2010 | Hardy | |
| 2010/0188221 | A1 | 7/2010 | Irmscher et al. | |
| 2010/0237093 | A1 | 9/2010 | Lockwood et al. | |
| 2011/0017763 | A1 | 1/2011 | Colelli et al. | |
| 2011/0042331 | A1 | 2/2011 | Johnson et al. | |
| 2011/0042332 | A1 | 2/2011 | Hardy | |
| 2011/0094975 | A1 | 4/2011 | Hardy | |
| 2011/0210084 | A1 | 9/2011 | Hardy | |
| 2011/0220597 | A1 | 9/2011 | Sherretts et al. | |
| 2011/0240569 | A1 | 10/2011 | Kahl et al. | |
| 2011/0284488 | A1 | 11/2011 | Hardy | |
| 2011/0284571 | A1 | 11/2011 | Lockwood et al. | |
| 2011/0315706 | A1 | 12/2011 | Lockwood et al. | |
| 2012/0000869 | A1 | 1/2012 | Hardy | |
| 2012/0285979 | A1 | 11/2012 | Lockwood | |

FOREIGN PATENT DOCUMENTS

| | | |
|---|---|---|
| DE | 202007011927 | 11/2007 |
| EP | 1541064 | 6/2005 |
| EP | 1579789 | 9/2005 |
| GB | 419302 | 11/1934 |
| GB | 849298 | 9/1960 |
| JP | 1144185 | 6/1989 |
| JP | 2219194 | 8/1990 |
| JP | 9319937 | 12/1997 |
| JP | 2005049965 | 1/2005 |
| JP | 2006285930 | 10/2006 |
| WO | 8912873 | 12/1989 |
| WO | 0022967 | 4/2000 |
| WO | 2004028311 | 4/2004 |
| WO | 2006085211 | 8/2006 |
| WO | 2007054042 | 5/2007 |
| WO | 2010094778 | 8/2010 |
| WO | 2010141552 A2 | 12/2010 |
| WO | 2010141552 A3 | 1/2011 |

OTHER PUBLICATIONS

U.S. Appl. No. 13/466,580, Notice of Allowance mailed Aug. 12, 2014, 5 pages.

European Patent Application No. 12167308.1, European Search Report, mailed Aug. 24, 2012, 7 pages.

European Patent Application No. 12167308.1, Office Action mailed Nov. 26, 2013, 2 Pages.

European Patent Application No. 12167308.1, Intent to Grant mailed Sep. 24, 2014, 28 Pages.

International Patent Application No. PCT/US2010/037026, Annex to Form PCTIISAI206—Communication Relating to the Results of the Partial International Search dated Aug. 20, 2010 in related Application No. PCT/US2010/037026, mailed Aug. 20, 2010.

International Patent Application No. PCT/US2010/037026, International Search Report and Written Opinion mailed Nov. 26, 2010.

International Patent Application No. PCT/US2010/037026, International Preliminary Report on Patentability mailed Dec. 15, 2011.

(56) References Cited

OTHER PUBLICATIONS

European Application No. 15153952.5, Extended European Search Report mailed on Jun. 16, 2015, 6 pages.

* cited by examiner

SECURE MERCHANDISING DISPLAY WITH TUNNEL FEATURE

RELATED APPLICATIONS

This is a continuation of U.S. patent application Ser. No. 13/466,580 filed May 8, 2012 titled "Secure Merchandising Display with Tunnel Feature," which claims the benefit of U.S. Provisional Application No. 61/484,246 filed May 10, 2011 titled "Secure Merchandising Display with Tunnel Feature," the contents of each of which are hereby incorporated by reference.

FIELD OF THE INVENTION

Embodiments generally relate to systems for controlling access to product in a retail or other environment.

BACKGROUND

Theft of items in retail stores is an all too common problem. Shelf sweeping, which occurs when individuals or groups remove all the shelf stock and exit the store, similar to a "smash and grab" shoplifting technique, is a common problem. Shelf sweeping relies on excessive quantities of product being available on the shelf. Retailers must keep substantial inventory on shelf or incur the cost, including labor costs, of constantly restocking. Theft of expensive items, such as liquor bottles, is also prevalent.

Retailers are constantly challenged to balance the needs of legitimate consumers' access to high theft items with measures to minimize the incidence of theft. Because theft has become so rampant in certain product categories, many retail stores are taking the products off the shelves and placing them behind the counter or under lock and key. Customers must request the products to make a purchase. This requires additional labor costs to provide individual service to customers who would normally not require it. It also makes it difficult for customers to compare products. Furthermore, it might not be feasible where space behind the counter is limited.

BRIEF SUMMARY

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings and each claim.

According to one embodiment, disclosed is a dispenser for housing a plurality of items, such as, but not limited to, bottles. The dispenser includes an opening that generally mirrors the shape and/or dimensions of the items stored within the dispenser plus a predetermined offset and that restricts access to the items stored within the dispenser. The dispenser also includes a tunnel formed within an interior of the dispenser that generally conforms to the shape of the items housed inside the dispenser. The configuration of the opening and/or the tunnel prevents a user from accessing items stored behind the opening within the dispenser. In some embodiments, the dispenser also includes a receiving area adjacent the front of the dispenser and located outside of the opening. In some embodiments, the dispenser includes a pusher system that provides a time delay between the dispensing of the items housed within the dispenser.

BRIEF DESCRIPTION OF THE DRAWINGS

The specification makes reference to the following appended figures, in which use of like reference numerals in different figures is intended to illustrate like or analogous components.

DETAILED DESCRIPTION

Disclosed is a dispenser for controlling access to product, such as, but not limited to, liquor or other bottles, housed within the dispenser.

Figure 1:
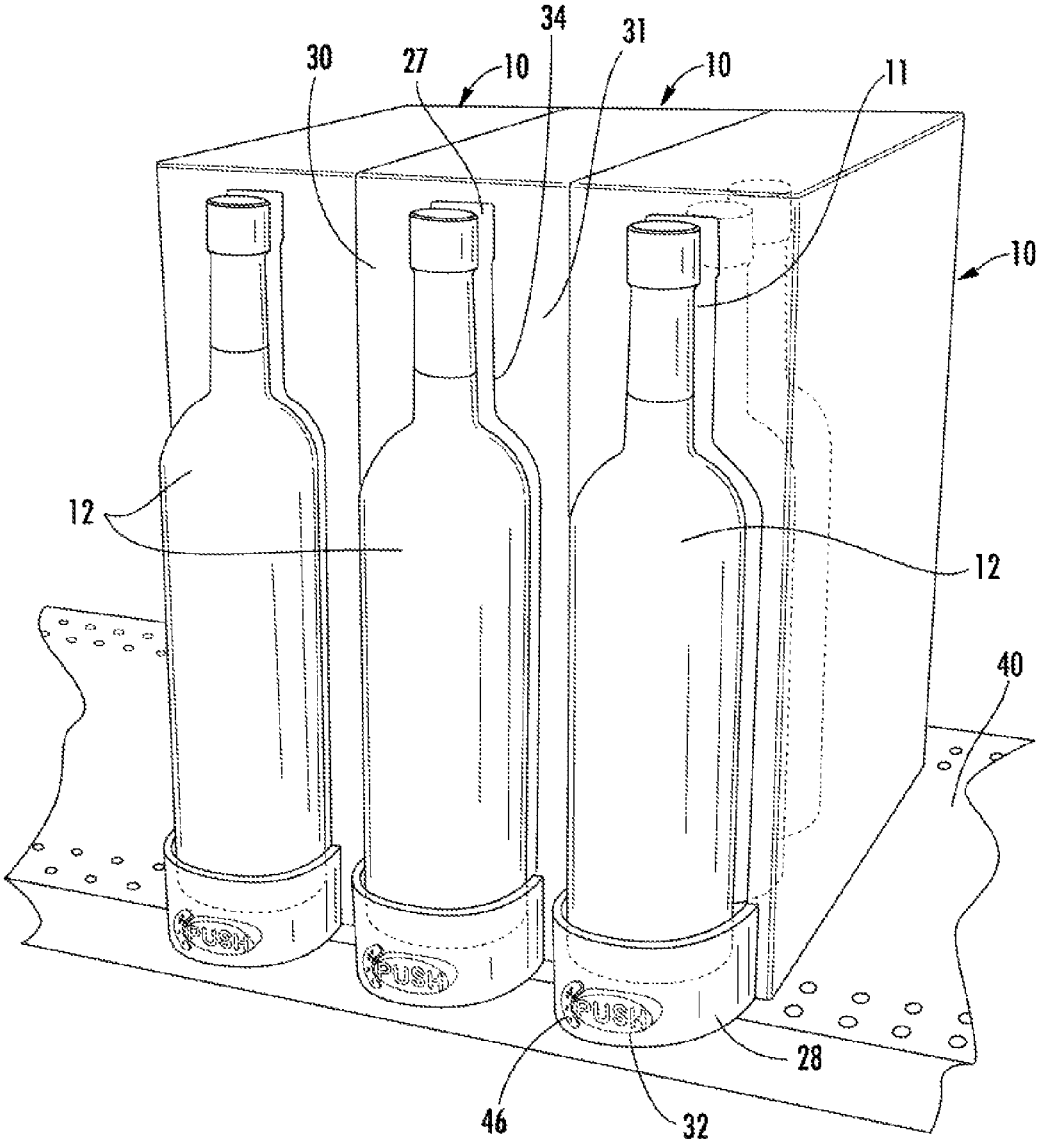
FIG. 1 is a perspective view of several dispensers on a shelf.
Figure 2:
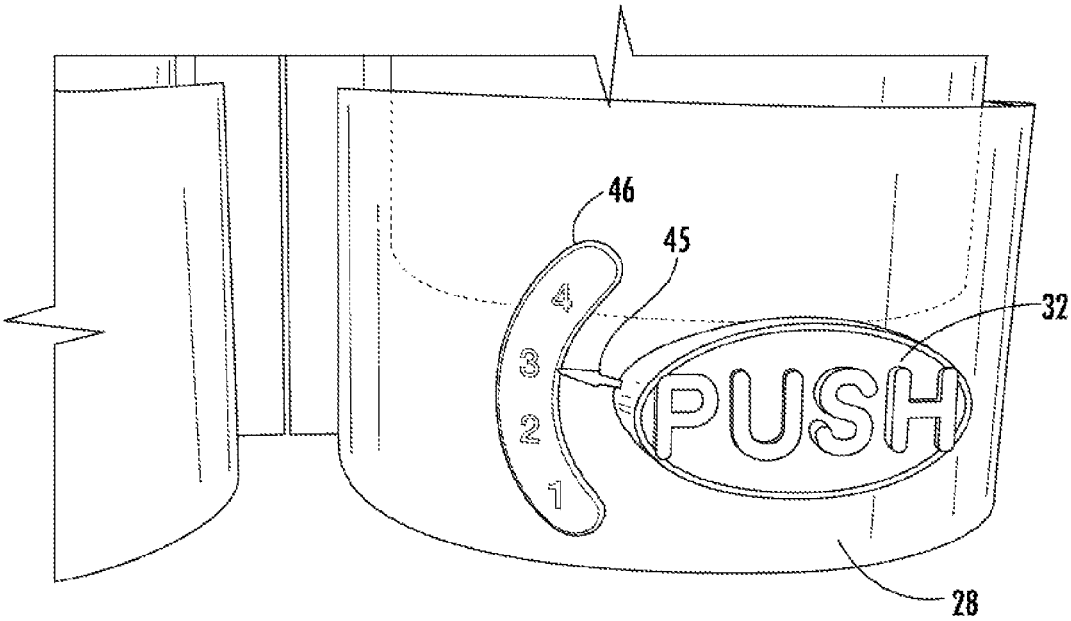
FIG. 2 is a close-up view of the receiving area of one of the dispensers of FIG. 1.
Figure 3:
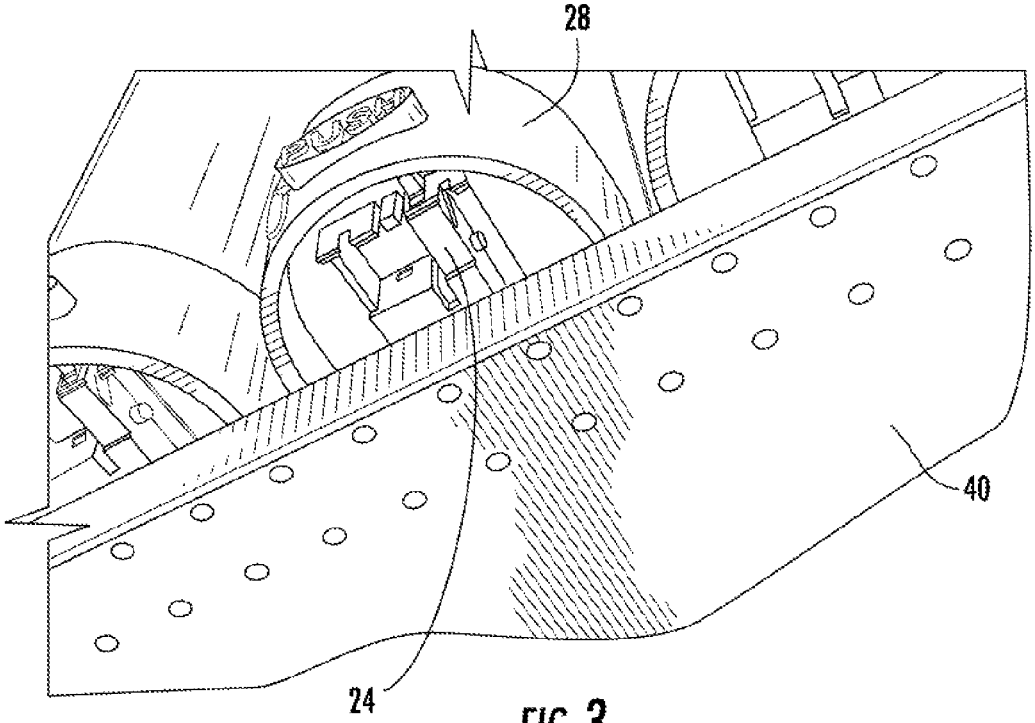
FIG. 3 is a partial bottom view of the dispensers of FIG. 1.

FIGS. 1-3 show a first embodiment of dispenser 10. FIG. 1 illustrates several dispensers 10 that are positioned adjacent one another on shelf 40. Bottles 12 are shown housed within each dispenser. Dispenser 10 includes a receiving area 28, which may be located toward the front of the dispenser and a portion of which may correspond to the shape and/or dimensions of the product being dispensed. For example, in the embodiments shown, receiving area 28 is configured to receive the circular base of a bottle such as bottle 12. Receiving area 28 may also include an actuator such as actuator 32, which may be a push button that a user depresses to dispense an item from dispenser 10 into the receiving area 28. Alternatively, actuator 32 may be positioned elsewhere on dispenser 10.

The front of dispenser 10 includes an opening 27 having a contour 34 that generally mirrors the shape and/or dimensions of the product housed inside the dispenser. As shown in FIG. 1, the contour 34 of the opening 27 of dispenser 10 mirrors the shape and dimensions of the bottle 12 stored within the dispenser. In some embodiments, the opening 27 is slightly larger than the bottle 12 to provide a minimal amount of clearance (also referred to as an offset), which prevents a user from reaching into the dispenser 10 to grab product housed within the dispenser while still allowing the bottle to move freely inside the dispenser and through the opening 27. In some embodiments, the amount of clearance (the distance between the opening and the bottle) is approximately 0.06 inches, although any suitable amount of clearance may be used. The amount of clearance will vary depending on the dispenser used and the product housed within the dispenser.

As shown in FIG. 1, the forward-most bottle is received within receiving area 28 and thus is outside of the opening 27 so that a user is free to access this forward-most bottle. Access to other bottles behind this forward-most bottle (stored within dispenser 10) is restricted by the shape and clearance/offset of the opening 27.

Figure 6:
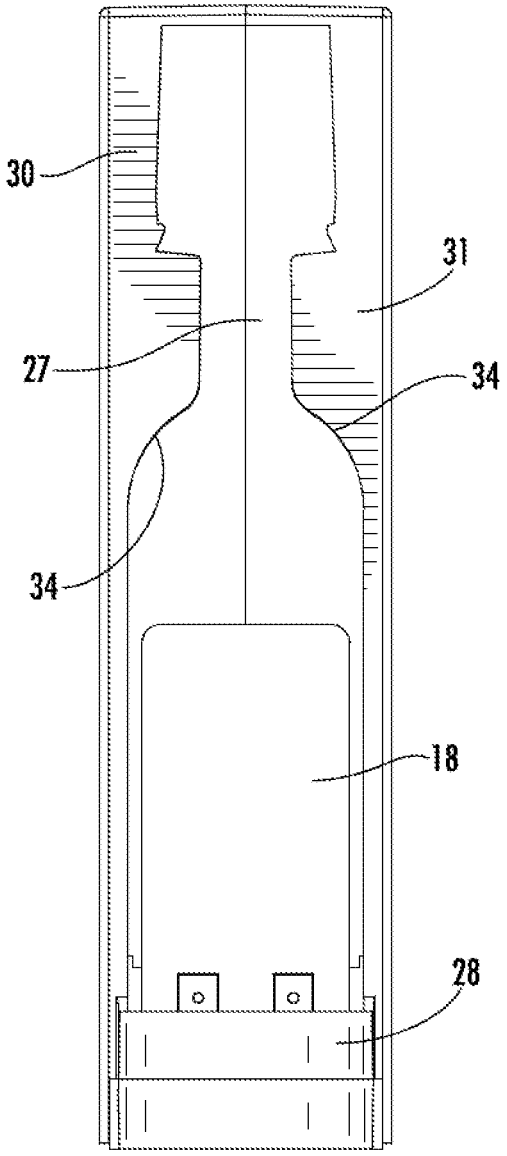
FIG. 6 is a front plan view of the dispenser of FIG. 5.
Figure 7:
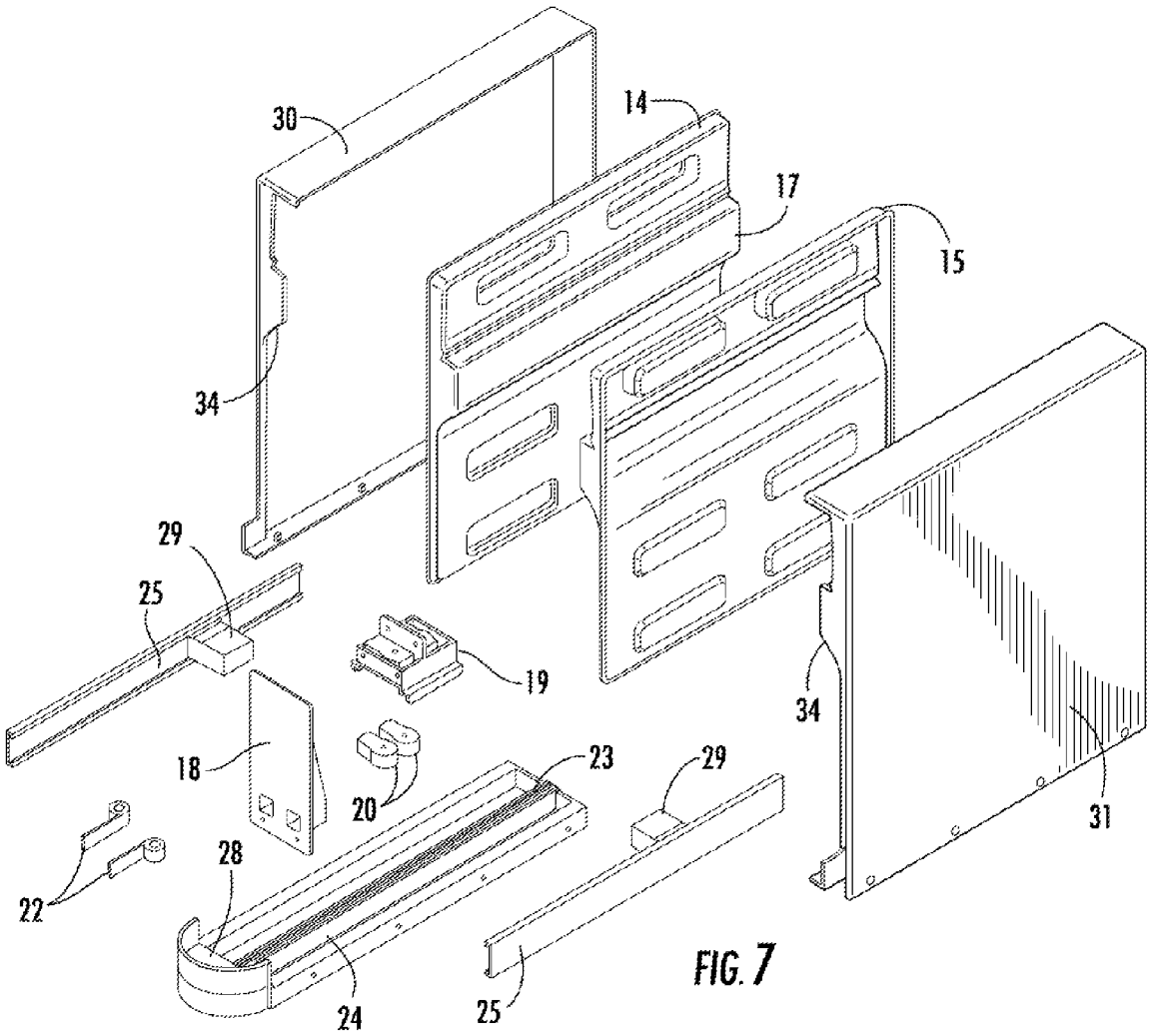
FIG. 7 is an exploded view of the dispenser of FIG. 5.
Figure 8:
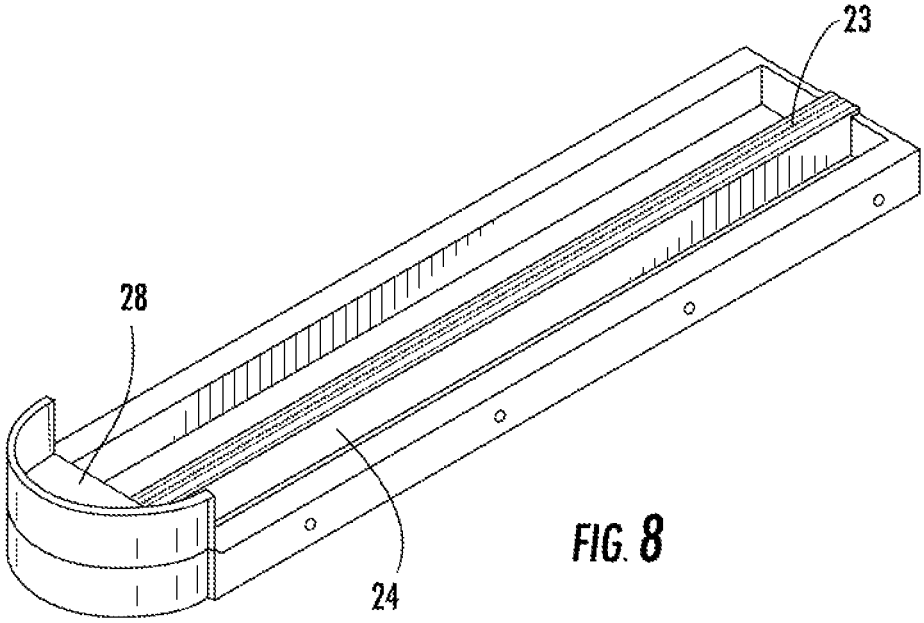
FIG. 8 is a perspective view of the track of the dispenser of FIG. 5.
Figure 9:
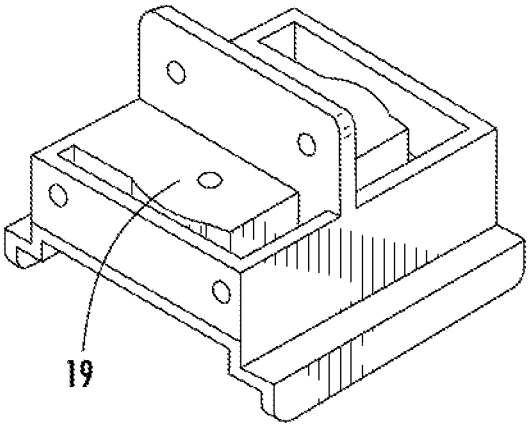
FIG. 9 is a perspective view of the pusher base of the dispenser of FIG. 5.
Figure 10:
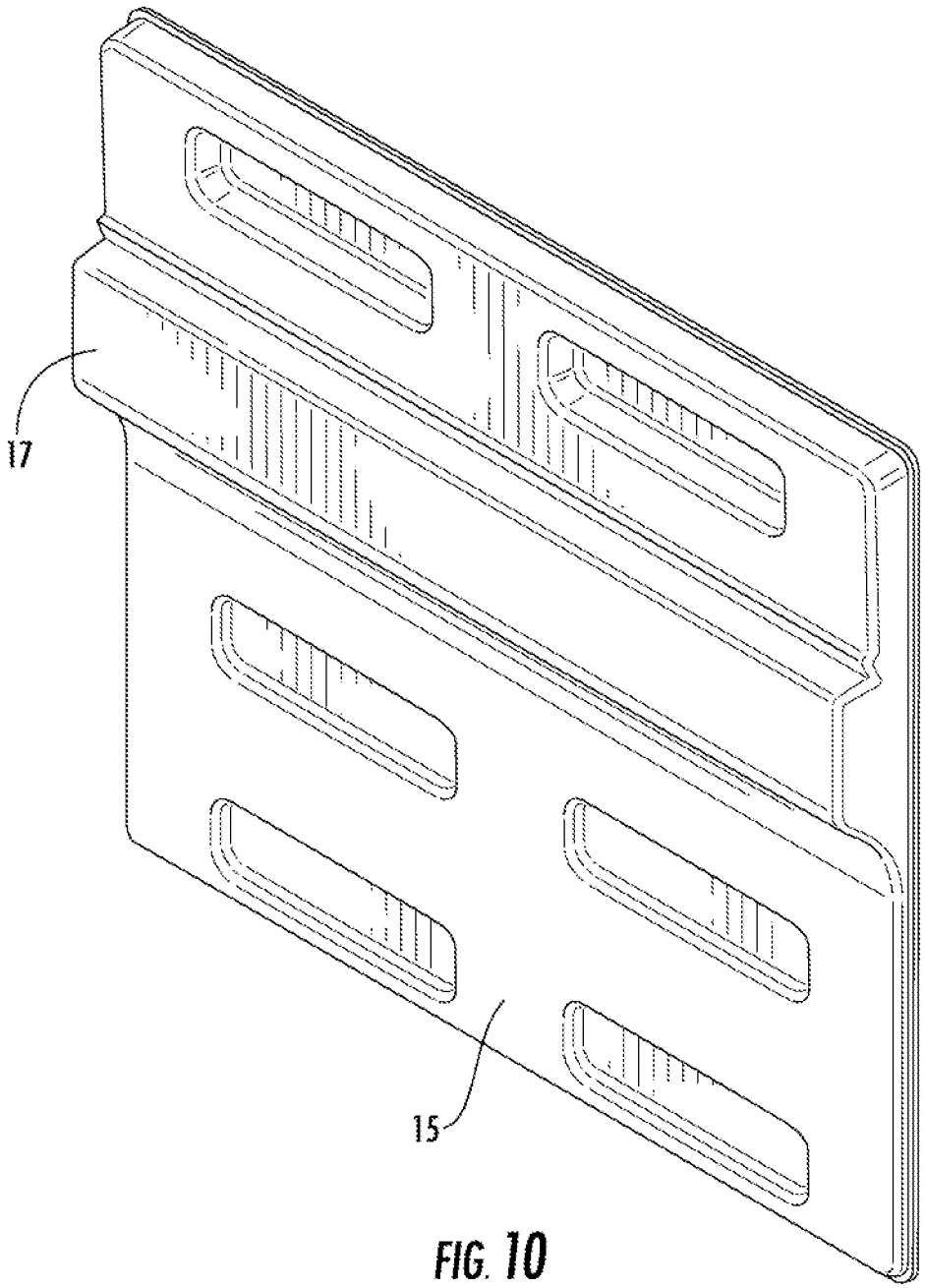
FIG. 10 is a perspective view of one of the inserts of the dispenser of FIG. 5.
Figure 11:
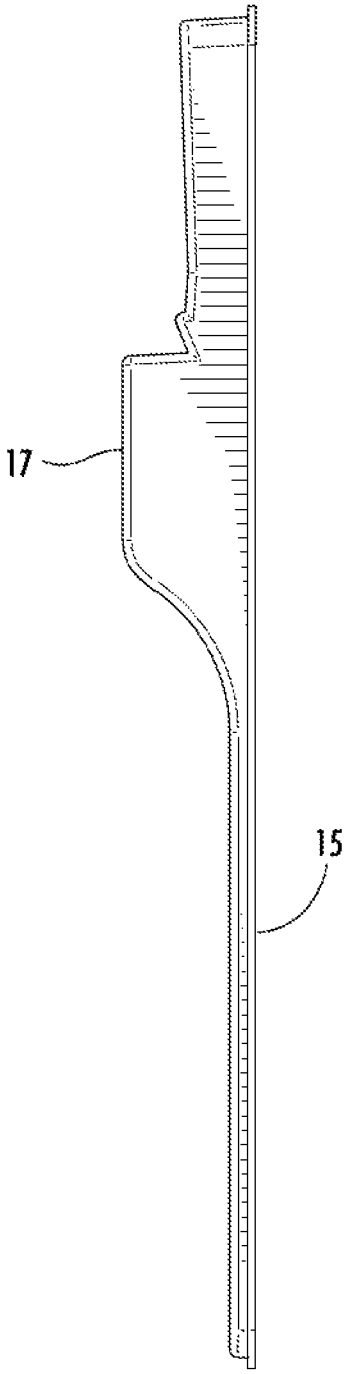
FIG. 11 is a side view of the insert of FIG. 10.

In some embodiments, as shown in FIG. 7, dispenser 10 includes two inserts 14 and 15 and two sidewalls 30 and 31. There are numerous ways to create opening 27. In the embodiment of FIG. 6, sidewalls 30 and 31 each include a portion of contour 34 so that when abutted together, sidewalls 30 and 31 define the opening 27. When the product housed inside the dispenser is cylindrical in shape, such as a bottle, the sidewalls 30 and 31 are mirror images of each other. In other embodiments, a single front wall defines opening 27.

First insert 14 and second insert 15 abut one another and each abut one of the sidewalls 30, 31 to form an insert within the dispenser 10, as shown in FIG. 7. When the product is symmetrical (as is the case with bottle 12), inserts 14, 15 may be identical. Inserts 14, 15 may each include a protrusion 17 (FIG. 7) or other component that generally extends along the interior of the dispenser to accommodate the neck 11 of the bottles (or other product) stored within the dispenser 10. In this way, the inserts form a "tunnel" that surrounds the bottles within the dispenser and, together with opening 27, prevents a consumer from reaching into the dispenser to grab a bottle that is located within the tunnel. As described above, consumer access to the forward-most product, which is located outside of the tunnel and outside of the opening 27, is unencumbered. Alternatively, a single insert may be used instead of inserts 14, 15. The insert(s) may, but not need, be vacuum formed or formed using injection molding. In some embodiments, use of the insert(s) reduces tooling costs since the mold of the insert alone may be modified to accommodate product having different dimensions.

Figure 4:
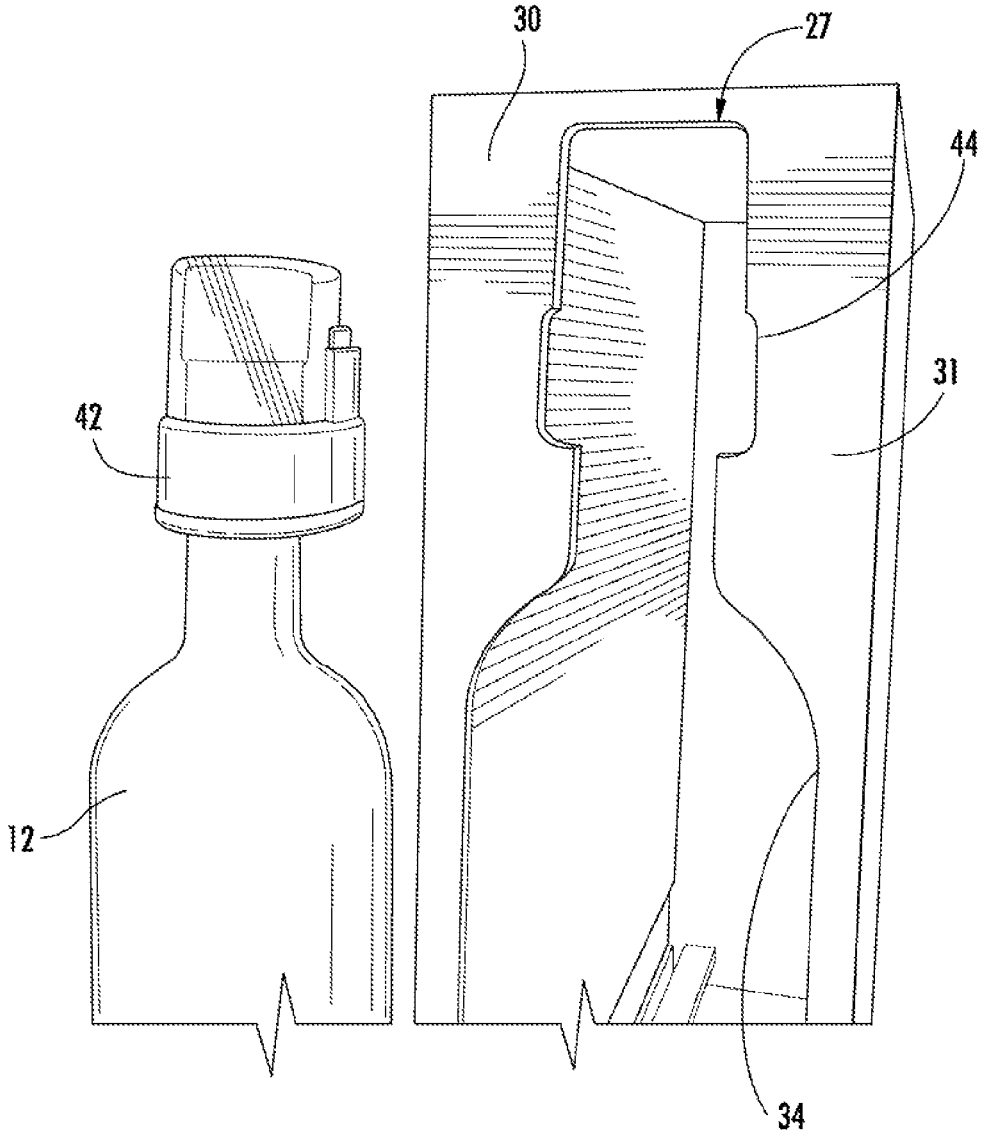
FIG. 4 is a partial perspective view of another embodiment of a dispenser, shown with respect to a bottle to be received within the dispenser.
Figure 5:
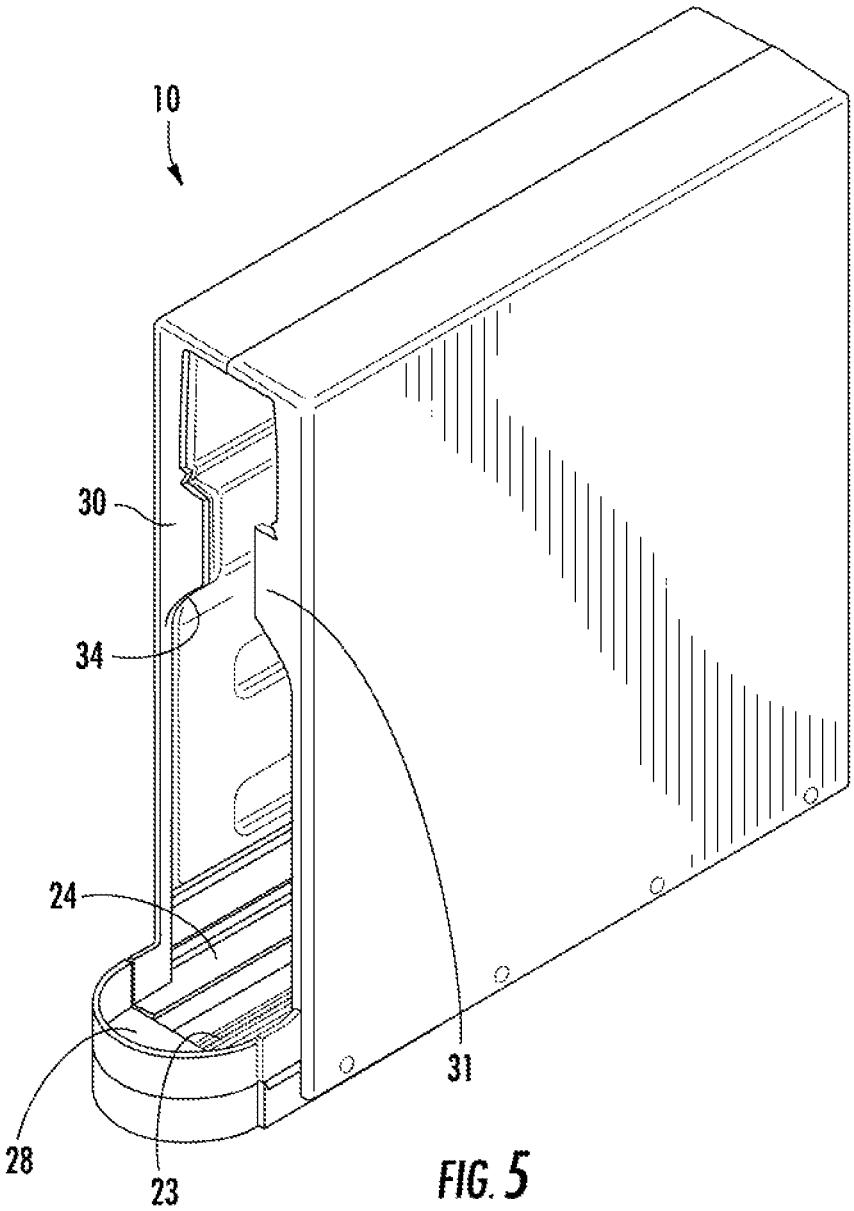
FIG. 5 is a perspective view of the dispenser of FIG. 4.

As shown in FIG. 4, dispenser 10 may be configured to house a bottle having a security cap 42 that produces an alarm if moved beyond a certain location. When the dispenser is so configured, the opening 27 includes a cutout 44 that accommodates the cap 42. In this way, modifications may be made to customize the configuration of the contour 34 of the opening 27 to accommodate various features (including loss prevention features) of the product stored within the dispenser 10. Dispenser 10 in some embodiments is sized to accommodate bottles (and other product) of various dimensions so that the dispenser is more universal. As described above, the dimensions of the molds for the inserts can then be modified to fit the dimensions of a particular bottle (or other product).

In some embodiments, dispenser 10 is front-loading. In some embodiments, dispenser 10 is a combination of top-loading and front-loading. In some embodiments, the dispenser also includes a time-delay feature in the form of a pusher system. When used, the pusher system advances the bottles or other product toward the front of the dispenser (and toward the receiving area 28) along track 24. In some embodiments, the pusher system utilizes a slow-motion feature, such as the slow-motion feature disclosed in U.S. Ser. No. 11/409,885 filed Apr. 24, 2006 and titled "Time Delay Product Pushing System," the contents of which are incorporated herein by reference. For example, the slow-motion feature can be achieved due to the interaction of a gear or other feature of one or more resistance mechanisms such as resistance mechanism 20 (shown in FIG. 7) with a rack gear 23 of the track 24. In some embodiments, resistance mechanisms 20 are housed within a pusher base 19. When used, pusher base 19 may be integral with pusher 18 or may be separate (as shown in FIG. 7). Resistance mechanism 20 may be positioned within pusher base 19 to maintain a one-to-one fit between the gear of the resistance mechanism 20 and the rack gear 23 so that the gears mesh well. The interaction of the gear of the resistance mechanism with the rack gear provides a time-delay between the advancing of products into the receiving area. In some embodiments, one or more springs 22 drive the pusher forward. In some embodiments, these springs are positioned on the interior of side walls 30, 31. As shown in FIG. 7, the springs may be housed in a compartment 29 of tracks 25.

In some embodiments, the springs are located with respect to the pusher to provide an optimal dynamic pushing force on the pusher 18. As shown in FIG. 7, springs 22 may be located relatively low in the assembly to provide a low, centralized weight to drive the pusher 18 so that the product maintains a generally upright orientation as it is pushed by pusher 18. In some embodiments, the springs are located behind the pusher 18. In some embodiments, product is loaded from the front of the dispenser, thus creating a load on the springs that powers the pusher in the opposite direction of the loading direction. In some embodiments, the pusher 18 is of sufficient height to maintain the orientation of the product within the dispenser when pushed by the pusher. In other words, the pusher 18 may be tall enough so that the pushing force is applied in a location that does not cause the product to lean or tip when pushed by pusher 18. In embodiments where the product stored within the dispenser is relatively tall, such as bottles of liquor, the pusher is taller to accommodate the height of the product.

In some embodiments, the dispenser includes a main product pusher and two additional spring-powered pushers to provide auxiliary power to move product stored within the dispenser.

In some embodiments, pusher 18 urges the bottles 12 or other product toward the receiving area 28, the receiving area having the same approximate diameter and/or shape as that of the product. In some embodiments, as described above, the receiving area 28 is located outside of the tunnel created by the inserts 14, 15 and outside of the opening 27.

In some embodiments, the dispenser is fabricated from cut sheets of acrylic or other suitable material. In some embodiments, the pusher system includes other features, such as a "start-stop" feature described in U.S. Ser. No. 12/792,252 filed Jun. 2, 2010 and titled "Time Delay Product Pushing System," the contents of which are incorporated herein by reference. The start-stop feature prevents the pusher from moving forward when a stop mechanism is engaged and permits the pusher to move forward when the stop mechanism is disengaged.

In some embodiments, the dispenser includes an analog meter or other suitable meter to keep track of and/or display the inventory inside the dispenser, as described in U.S. Ser. No. 12/567,370 filed Sep. 25, 2009 and titled "Dispensing and Display System," the contents of which are incorporated herein by reference. For example, a shaft, such as a helical shaft, may cooperate with the pusher 18 so that forward movement of the pusher 18 rotates the shaft. The end of the shaft optionally may include an indexing arrow (such as arrow 45 in FIG. 2) that rotates with the rotation of the shaft and indicates the number of bottles or other product remaining in the dispenser 10. In other embodiments, the shaft cooperates with a position sensor to send a signal to an electronic processor that processes and analyzes the information. For example, the amount of rotation of the shaft can be used to determine the number of products removed from the dispenser and/or the number of products that remain housed within the dispenser. The front of the dispenser 10 may include a meter or other indicator (such as indicator 46 in FIGS. 1 and 2) that indicates the number of bottles remaining inside the dispenser 10. In other embodiments, the dispenser includes an electronic inventory feature. The dispenser may also include an enunciator.

In lieu of a rotatable shaft, any suitable mechanism may activate a potentiometer or other suitable position sensor. For example, the gear of the resistance mechanism (or any other aspect of the pusher system) may interact with the rack gear 23 of the track 24, which in turn interacts with a potentiometer or other suitable position sensor to track movement of the pusher. In this example, the lineal movement of the pusher along the track, via the gearing, drives rotary motion of the potentiometer or other position sensor. The position sensor may be configured to send a signal associated with its position to a receiving device. The information about the position of the position sensor can be correlated to movement of the pusher and analyzed to track the amount of inventory remaining within the dispenser. Alternatively, a component of the pusher system (such as, but not limited to, the gear of the one or more resistance mechanisms) may activate a counter that incrementally adjusts based on movement of the pusher along the track.

In some embodiments, the dispenser is placed on a shelf, such as shelf 40. Dispenser 10 may also be attached to the shelf with nut and bolt hardware or in any other suitable manner. As shown in FIG. 1, one or more dispensers may be positioned on a shelf adjacent one another.

The embodiments described above are illustrative and non-limiting. Many variations of the structures illustrated in the drawings and the materials described are possible and within the scope of this invention. For example, items other than bottles may be housed within the dispenser. Both symmetrical and asymmetrical items may be housed within the dispenser.

What is claimed is:

1. A dispenser for housing a plurality of products, the dispenser comprising:

a surface comprising an opening that restricts access to the products stored within the dispenser, the opening generally conforming to a shape of the products plus an offset;

a receiving area adjacent the surface of the dispenser;

a first sidewall and a second sidewall;

a tunnel formed within an interior of the dispenser; and one or more inserts that generally extend along an interior of the dispenser between the first and second sidewalls to accommodate and generally conform to the shape of the plurality of products housed within the dispenser.

2. The dispenser of claim 1, wherein a shape and dimensions of at least a portion of the receiving area generally conforms to the shape and dimensions of the products plus an offset.

3. The dispenser of claim 1, further comprising an actuator for actuating the dispensing of one of the plurality of products.

4. The dispenser of claim 1, further comprising a pusher system that advances the products housed within the dispenser toward the opening.

5. The dispenser of claim 4, wherein the pusher system comprises a track, a pusher in sliding engagement with the track, a spring that urges the pusher along the track, and a resistance mechanism that slows a speed at which the pusher advances the products.

6. The dispenser of claim 4, wherein the first and second sidewalls abut one another to define the opening.

7. The dispenser of claim 1, wherein the one or more inserts comprises a protrusion that generally extends along the one or more inserts and accommodates a neck of one of the products housed within the dispenser.

8. The dispenser of claim 7, wherein the protrusion of the one or more inserts conforms to the shape of the products housed within the dispenser.

9. The dispenser of claim 1, wherein the opening provides clearance between a contour of the opening and the products.

10. The dispenser of claim 1, wherein the offset is generally uniform along the opening.

11. The dispenser of claim 1, wherein the opening generally mirrors a shape of the products substantially along a height of the products.

12. The dispenser of claim 5, wherein the pusher system activates a position sensor to indicate at least one of the following: (a) removal of a product from the dispenser; (b) the number of products removed from the dispenser; and (c) the number of products remaining in the dispenser.

13. A dispenser for housing a plurality of product, the dispenser comprising:

a front comprising an opening that restricts access to the product stored behind the opening within the dispenser, the opening having a substantially similar shape and dimensions as those of the product plus a clearance;

one or more sidewalls forming the opening;

a tunnel that extends along an interior of the dispenser, wherein the tunnel comprises one or more inserts, each of the one or more inserts generally conforming to the shape of the product and comprising a protrusion that generally extends along the one or more inserts and accommodates a portion of the product housed within the dispenser; and a pusher system comprising a track, a pusher in sliding engagement with the track, a device configured to urge the pusher along the track toward the front of the dispenser, and a resistance mechanism that slows a speed at which the pusher advances the product toward the front of the dispenser.

14. The dispenser of claim 13, wherein the tunnel generally conforms to the shape and dimensions of the product.

15. The dispenser of claim 13, further comprising a receiving area adjacent the front of the dispenser and located in front of the opening, wherein a shape of at least a portion of the receiving area generally conforms to the shape of the product.

16. The dispenser of claim 13, wherein the clearance is generally uniform along the opening.

17. The dispenser of claim 13, wherein the opening generally mirrors a shape and dimensions of the product substantially along a height of the product.

18. The dispenser of claim 13, wherein the pusher system activates a position sensor to indicate at least one of the following: (a) removal of a product from the dispenser; (b) the number of product removed from the dispenser; and (c) the number of products remaining in the dispenser.

19. A dispenser for housing a plurality of items, the dispenser comprising:

a front comprising an opening that restricts access to the items stored within the dispenser, the opening generally mirroring a shape of the items along a height of the items plus a clearance;

a tunnel formed within an interior of the dispenser that surrounds the items stored within the dispenser, wherein the tunnel comprises one or more inserts each generally conforming to the shape of the product and comprising a protrusion that generally extends along the insert and accommodates a portion of the items stored within the dispenser;

a receiving area adjacent the front of the dispenser located outside of the tunnel; and a pushing device that controls advancement of the items toward the receiving area.

20. The dispenser of claim 19, wherein the clearance is generally uniform along the opening.

* * * * *